United States Patent [19]

Eiermann

[11] 4,218,199

[45] Aug. 19, 1980

[54] ROTARY PISTON COMPRESSOR WITH NO NEGATIVE TORQUE

[75] Inventor: Dankwart Eiermann, Lindau, Fed. Rep. of Germany

[73] Assignees: Borsig GmbH; Wankel GmbH, both of Berlin, Fed. Rep. of Germany

[21] Appl. No.: 945,633

[22] Filed: Sep. 25, 1978

[30] Foreign Application Priority Data

Sep. 24, 1977 [DE] Fed. Rep. of Germany ..... 2743038

[51] Int. Cl.[2] ..... F04C 17/02; F04C 29/08

[52] U.S. Cl. ..... 418/54

[58] Field of Search ..... 418/54, 61 A

[56] References Cited

U.S. PATENT DOCUMENTS

| | | | |
|---|---|---|---|
| 1,636,486 | 7/1927 | Planche | 418/54 |
| 4,105,375 | 8/1978 | Schindelhauer | 418/54 |

*Primary Examiner*—John J. Vrablik

*Attorney, Agent, or Firm*—Becker & Becker, Inc.

[57] ABSTRACT

A rotary piston compressor of trochoidal type construction with a 1:2 step-up transmission gearing and operating in slip contact. The compressor has a side inlet with an inlet port control edge located in leading direction of piston rotation. A piston edge portion moves ahead and coincides with the inlet port control edge before the piston is located in its dead center position. A peripheral outlet port is provided having a control edge. A follower piston lobe at the same time traverses the peripheral outlet port to uncover it. The control edge of the inlet port which trails in the direction of rotation coincides with a trailing piston edge portion when the follower piston lobe is behind the outlet port in the direction of rotation.

2 Claims, 1 Drawing Figure

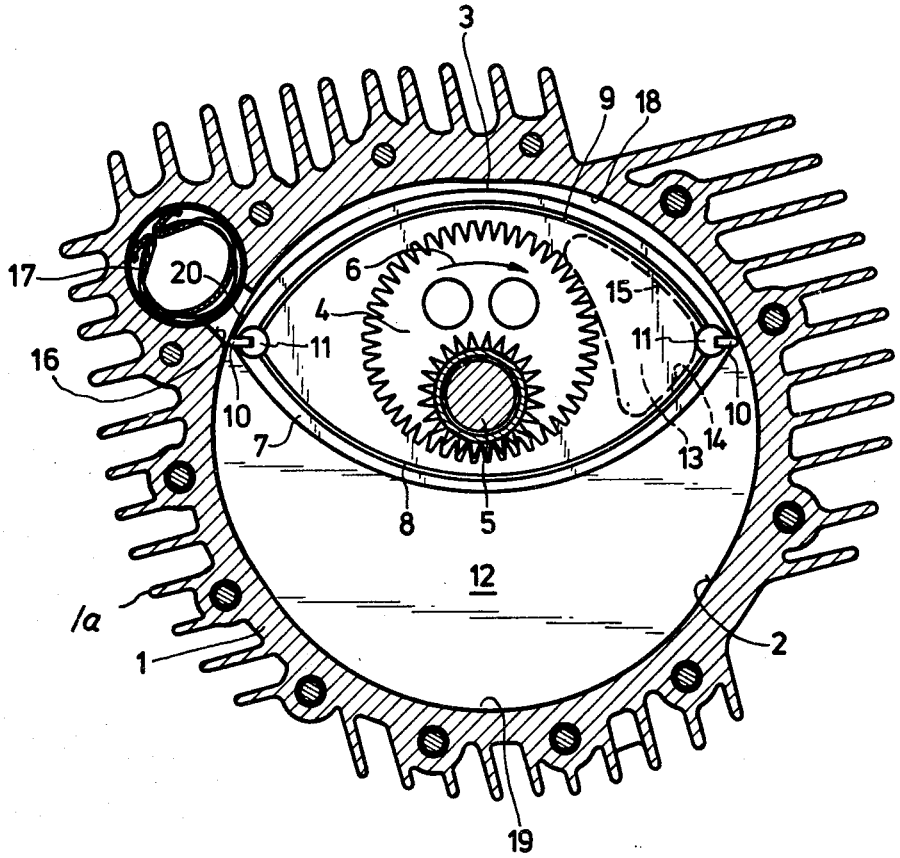
3
9
18
17
20
6
15
4
11
11
16
10
10
7
13
14
8
5
12
1a
1
2
19

ROTARY PISTON COMPRESSOR WITH NO NEGATIVE TORQUE

The present invention relates to a rotary piston compressor of trochoidal design, with a 1:2 step-up transmission gearing which operates in slip contact and comprises a side inlet. More specifically, the invention concerns the position of the said side inlet.

Rotary piston engines of this type are provided with a two-tip piston revolving on an eccentric of the main or propeller shaft. The piston forms two working chambers with a varying volume, which are enclosed by the piston and a single-arch trochoidal shell orbit and side walls. Engines of this kind entail the disadvantage that a retroactive expansion of the occluded gas occurs in the compression chamber, which causes a negative torque, after the outlet port has been closed off and before the inlet port is uncovered when the respective chamber is increasing again, i.e. when the piston continues to revolve beyond its dead-center position. The result is not only a very uneven running and a rough operation of the compressor, with a corresponding noise development and corresponding losses due to vibration, but, above all, a resonant rise of torsional vibrations of the propeller shaft, which, as a matter of experience, may cause breakage.

German Offenlegungsschrift No. DT-OS 24 02 084 discloses such an engine with a peripheral inlet, which is said to avoid these disadvantages. However, in said engine losses in filling and comparatively loud intake noises were put up with as a consequence of the occurring pulsations, which would require a higher silencing expenditure in order to overcome this drawback.

It is the object of the present invention to eliminate the aforementioned disadvantages.

As a solution to this problem it is proposed that the control edge of the inlet port, which is leading in the direction of rotation, coincides with the piston edge moving ahead of it, before the piston is in its dead-center position and, at the same time, the following piston lobe traverses the peripheral outlet port to uncover it, and that the control edge of the inlet port, which is trailing in the direction of rotation, coincides with the trailing piston edge when the follower piston lobe is behind the outlet port in the direction of rotation.

It is expedient that the piston traverses the inlet port to close it off at an angular displacement of 5° to 10°, related to its dead-center position, and that the piston has continued its rotary movement by 10° to 35° of the eccentric angle, related to its dead-center position, when it has traversed the peripheral outlet port to close it off.

Tests have shown that with this design, very low torque variations are produced, especially at higher pressures and rotary speeds, and that thus an even compressor running is achieved. Furthermore, the intake noises are substantially reduced, and the volumetric efficiency is greatly improved. In this connection, the specific driving power is increased over that of compressors with the same power input rate but without the system according to the present invention, which latter furnishes the possibility of reducing the dimensions of the engine.

The invention is illustrated by way of example in the accompanying drawing showing partly in plan view and partly in section a compressor according to the invention with the piston in its dead-center position.

The housing 1, which is provided with cooling fins 1*a*, comprises a trochoidal shell orbit 2, the region adjacent to the axis being shown at 3. The piston 7 is completely sealed and is revolving, in the direction of the arrow 6, on the eccentric 4 of the propeller shaft 5. On the edges of either side, the piston is provided with axial sealing strips 8 and 9, and, at its tips, has radial vertex-ledges 10 which are connected by sealing pins 11 to the sealing strips on both sides. Even though the drawing shows only those sealing components of the piston which are provided on top, it should be understood that the sealing ledges at the bottom, which are described here, are coinciding with those shown on top in the plan view.

In side wall 12, which is visible in the plan view, an inlet port 13 is provided. The control edge of port 13, which is leading in the direction of rotation of the piston, is shown at 14, while reference numeral 15 denotes the port control edge that is trailing in the direction of rotation.

An outlet port 16 is provided in the orbit in the housing and behind port 16 there is arranged a pressure valve 17. In the piston positioned as shown in the drawing, the leading edge of piston 7—i.e. the lower sealing strip 8 provided at that edge—has just traversed the inlet port 13 to close it off, and, at the same time, the piston tip—i.e. the vertex ledge 10 of said tip—has just traversed the outlet port 16 to uncover it. The gas pressure in the chamber 18, which would create a negative torque when the piston 7 would continue its rotary movement, is now relieved through the dead-center space 20 in front of valve 17 in the outlet port 16 into the compression chamber 19 which is still under the outside pressure and in a state of expansion which is still at its maximum.

It is reasonable and obvious that the invention can be applied to inlet ports on both sides by way of analogy.

It is, of course, to be understood that the present invention is, by no means, limited to the specific showing in the drawing but also encompasses any modifications within the scope of the appended claims.

What I claim is:

1. A rotary piston compressor of trochoidal type construction with a 1:2 step-up transmission gearing operative in slip contact, comprising: a housing forming a compressor space, a side inlet port means in the housing, said inlet port means having a control edge located in the leading direction of rotation, an eccentrically rotating lobed piston in the compressor space forming chamber therein and having a piston edge moving ahead of and coinciding with the said control edge shortly before said piston is located in its dead-center position, a peripheral outlet port in the housing means having a rear control edge and dead-center space in communication therewith, and a follower piston lobe which at the same time, shortly before said piston is located in its dead center position, traverses the peripheral outlet port means to uncover it, to allow communication with the dead-center space for permitting relief of gas pressure in one of the chambers formed with said piston to avoid creation of any negative torque otherwise encountered therewith, the control edge of the inlet port means which trails in the direction of rotation coinciding with a trailing piston edge portion when said follower piston lobe is behind the outlet port means in the direction of rotation.

2. A rotary piston compressor according to claim 1, in which said piston traverses the inlet port means to close it off at an angular displacement of 5° to 10° ahead of the dead-center position thereof, said piston having traversed the peripheral outlet port means to close it off also has continued rotary movement thereof by 10° to 35° of the eccentric angle in relation to dead-center position thereof.

* * * * *